US009222195B2

(12) United States Patent
McHugh et al.

(10) Patent No.: US 9,222,195 B2
(45) Date of Patent: Dec. 29, 2015

(54) ELECTROPLATING SYSTEMS AND METHODS FOR HIGH SHEET RESISTANCE SUBSTRATES

(75) Inventors: Paul R. McHugh, Kalispell, MT (US); Gregory J. Wilson, Kalispell, MT (US)

(73) Assignee: APPLIED Materials, Inc., Santa Clara, CA (US)

( * ) Notice: Subject to any disclaimer, the term of this patent is extended or adjusted under 35 U.S.C. 154(b) by 476 days.

(21) Appl. No.: 13/603,836

(22) Filed: Sep. 5, 2012

(65) Prior Publication Data

US 2014/0061053 A1 Mar. 6, 2014

(51) Int. Cl.

| | |
|---|---|
| ***C25D 21/12*** | (2006.01) |
| ***C25D 17/00*** | (2006.01) |
| *C25D 7/12* | (2006.01) |

(52) U.S. Cl.

CPC ..... *C25D 21/12* (2013.01); *C25D 17/001* (2013.01); *C25D 17/008* (2013.01); *C25D 7/123* (2013.01)

(58) Field of Classification Search

CPC ..... C25D 21/12–21/144; C25D 7/12–7/123
See application file for complete search history.

(56) References Cited

U.S. PATENT DOCUMENTS

| | | | | |
|---|---|---|---|---|
| 6,755,946 | B1 * | 6/2004 | Patton et al. | 204/224 R |
| 6,773,571 | B1 | 8/2004 | Mayer et al. | |
| 7,020,537 | B2 | 3/2006 | Wilson et al. | |
| 2003/0209445 | A1 * | 11/2003 | Talieh et al. | 205/157 |
| 2005/0178667 | A1 | 8/2005 | Wilson et al. | |
| 2006/0086616 | A1 * | 4/2006 | Kurashina et al. | 205/83 |
| 2006/0266653 | A1 * | 11/2006 | Birang et al. | 205/83 |
| 2007/0144912 | A1 * | 6/2007 | Woodruff | 205/148 |
| 2007/0238265 | A1 * | 10/2007 | Kurashina et al. | 438/470 |

* cited by examiner

*Primary Examiner* — James Lin
*Assistant Examiner* — Ho-Sung Chung
(74) *Attorney, Agent, or Firm* — Kenneth H. Ohriner; Perkins Coie LLP

(57) ABSTRACT

In an electroplating process, electric current is applied to two or more electrodes, with the current varying over time according to a multi-variable function. The multi-variable current function is integrated over time, for each electrode, to determine a net plating charge delivered. A plating profile of a plated-on layer of material is compared to a target plating profile. Deviations between the actual plating profile and the target plating profile are identified and used to determine new net plating charges for each electrode. One or more variables of the multi-variable function is changed to provide a new multi-variable function. The new net plating charges are distributed according to the new multi-variable current function, and are used to electroplate a layer of material on a second substrate.

7 Claims, 9 Drawing Sheets

Simulation conditions: Seed Rs= 25 Ohm/sq
0.975 Amp-min deposition (4.5 Amps for 13 sec)
5 mm gap
Thickness (Angstroms)
400
390
380
370
360
350
0
50
100
150
Radius (mm)

ELECTROPLATING SYSTEMS AND METHODS FOR HIGH SHEET RESISTANCE SUBSTRATES

BACKGROUND OF THE INVENTION

A challenge in electroplating uniform metal layers in manufacturing semiconductor and other micro-scale devices is producing and maintaining a desired electrical field at the surface of the wafer or substrate. The distribution of electrical current in the plating solution is a function of the uniformity of the seed layer across the contact surface, the resistance of the seed layer, the configuration/condition of the anode, electrolyte flow characteristics and the configuration of the chamber. However, the current density profile on the plating surface can change. For example, the current density profile typically changes during a plating cycle because as metal is plated onto the seed layer, its electrical characteristics change. This can occur within a few seconds, or even in a fraction of a second. Current density can change over a longer period of time because the shape of consumable anodes changes as they erode and the concentration of constituents in the plating solution can change. Therefore, it can be difficult to maintain a desired current density at the surface of the wafer, to form uniform void-free plated layers, and to achieve a final profile shape of the plated layer as desired for subsequent processing.

As one particular example, the current density can be significantly higher near the edge of the wafer and at the junctions between the contact elements and the wafer than at other locations on the wafer. This is referred to as the "terminal effect." The terminal effect can result in electroplated layers that are not uniformly thick, contain voids, or have impurities or defects. These tend to reduce the manufacturing yield of defect-free devices.

Electroplating systems currently used in the semiconductor industry have two or more electrodes, typically set up as anode plates or rings. The distribution of electrical current provided by each anode may be actively varied the during the plating process. This dynamic current control may be used to achieve a specific profile for a conductive layer on the workpiece or to account for temporally and/or spatially varying characteristics of the electrical processing.

Some electroplating systems also have an optimization capability that can select and adjust electrical processing parameters, specifically the current profile over time for each anode. The optimization adjusts the electrical processing parameters in accordance with either a mathematical model of the processing chamber or experimental data derived from operating the actual processing chamber. In these optimization systems, after a workpiece is processed with the initial parameters, the actual results on the plated substrate are measured. A sensitivity matrix based upon the mathematical model of the processing chamber is then used to select new parameters that correct for any deficiencies measured in the processing of the first workpiece.

These parameters are then used in processing a second workpiece, which may be similarly measured, and the results used to further refine the processing parameters. These optimization systems can also profile the seed layer on a substrate before the electroplating process. This information can then be used to determine an initial set of process parameters designed to electroplate a metal layer onto the seed layer in is way that compensates for deficiencies in the seed layer.

The seed layer is generally formed on the substrate using chemical vapor deposition (CVD), physical vapor deposition (PVD), electroless plating processes, or other suitable methods. The seed layer is needed for subsequent electroplating because electroplating requires a conductive surface, and the bare substrate, such as a silicon wafer, is generally not sufficiently conductive. The trend in semiconductor technology is towards thin seed layers required for producing smaller features. Thin seed layers are also faster to apply and may have other advantages as well. On the other hand, electroplating onto a thin seed layer further increases the engineering challenges of designing and controlling electrochemical plating systems. Very thin seed layers, for example having a sheet resistance of 50 Ohms/sq or higher, require more extreme chamber electrode current adjustments, and make it more difficult to predict how the sheet resistance changes during the plating process.

Accordingly, there is a need for electrochemical plating systems and methods better adapted to processing substrates having thin seed layers.

SUMMARY OF THE INVENTION

Known electroplating methods have used feed-back or feed-forward optimization techniques to adjust electrode current when plating a subsequent substrate based on the measured or as-plated results on a previous substrate. Known electroplating methods have also used in-process changes to electrode current, or dynamic current control, to achieve improved plated metal layers. However, these techniques by themselves are not well suited for plating onto substrates having a sheet resistance of 50 Ohm/sq or higher, e.g., up to 1000 or 2000 Ohm/sq.

It has now been discovered however, that dramatically improved electroplating may be achieved on highly resistive seed layers by greatly accelerating dynamic current control, into the range of about 50 to 1000 current changes during the initial 10, 15 or 20 second time interval, while the sheet resistance is still very high. This accelerated dynamic current control can then be combined with optimization to provide further improved results.

DETAILED DESCRIPTION

When electroplating metal onto substrates having very thin seed layers (30-50 Ohms/so or higher), predicting how the sheet resistance will change during the process becomes difficult because of uncertainty of how the bulk resistivity and features effect sheet resistance. This in turn makes it difficult to plate uniform layers having desired characteristics. A new control process, or method for controlling the electroplating chamber, has now been invented to compensate for these factors. In this new method, current from the anodes is dynamically controlled, with the ratio of electric current provided by the anodes changed over time during the plating process. In addition, feed back and/or feed forward techniques are used in combination with the dynamic current control, to achieve improved plating results.

In one example, a dynamic current control process for an electrochemical processor can have e.g. 50 to 1000 sub-steps where the currents are changing every 25-100 milliseconds. The processor may have three electrodes, i.e., two anodes and one thief electrode. The current provided by each electrode is varied during the plating process. The variation in current of each electrode is balanced, or changed together, so that the total current provided to the wafer remains constant over the entire plating process. In a typical processor, the total current may be 2.5 to 20 Amps. The electrode current schedule, i.e., the current from each electrode over time, may be pre-calculated using an initial seed layer sheet resistance as well as an expected change in sheet resistance as metal is plated onto the sheet layer. The pre-calculated dynamic current control schedule may then be continuously optimized by based on the measured results of previously plated wafers.

Figure 1:
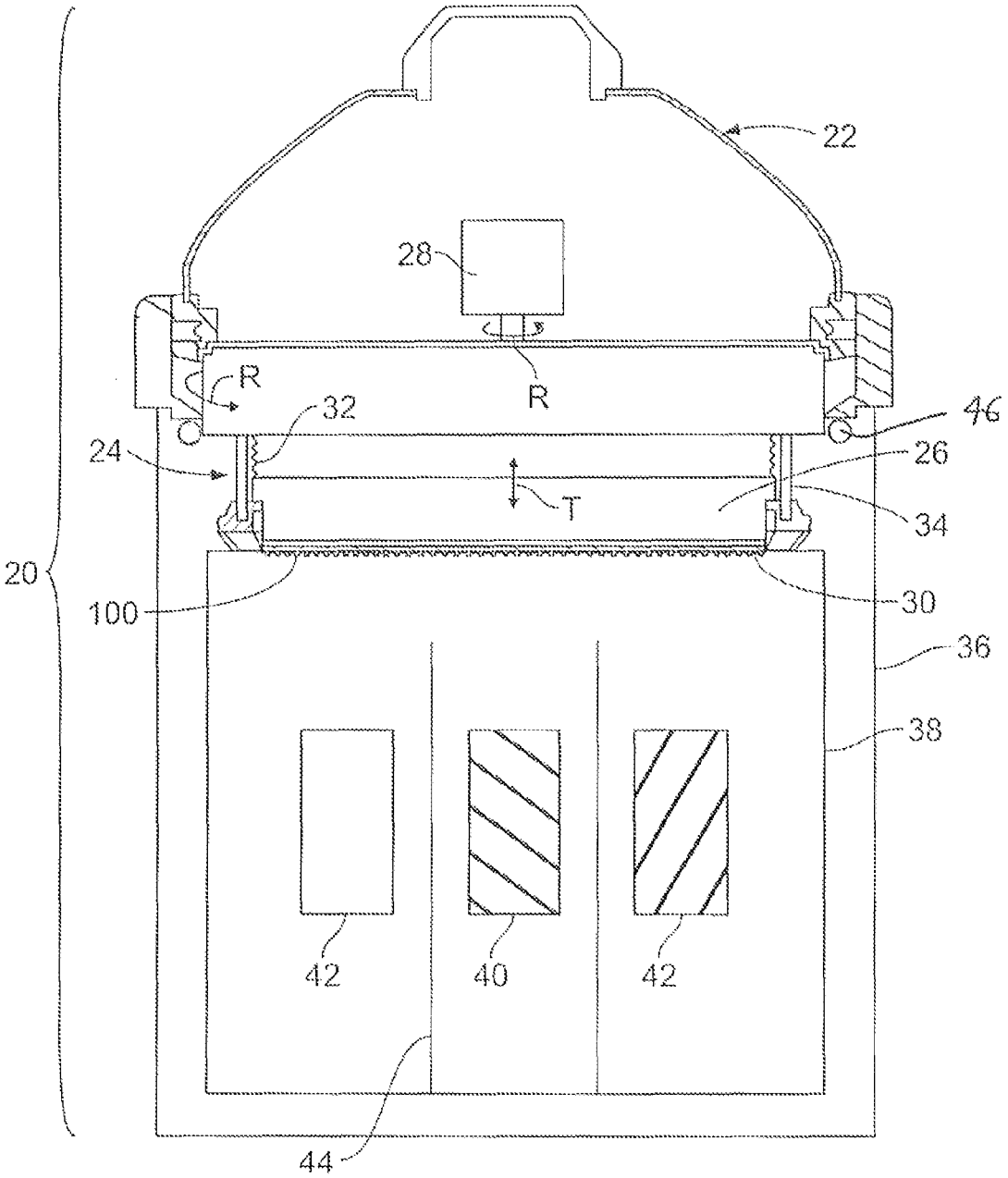
FIG. 1 is a schematic diagram of an electroplating reactor having two anodes and a thief electrode.

As shown in FIG. 1, and electro processing chamber 20 has a head 22 including a rotor 24. A motor 28 in the head 22 rotates the rotor 24, as indicated by the arrow R in FIG. 1. A contact ring assembly 30 on the rotor 24 makes electrical contact with a work piece or wafer 100 held into or onto the rotor 24. The rotor 24 may include a backing plate 26, and ring actuators 34 for moving the contact ring assembly 30 vertically (in the direction T in FIG. 1 between a wafer load/unload position and a processing position. The head 22 may include bellows 32 to allow for vertical or axial movement of the contact ring while sealing internal head components from process liquids and vapors.

Referring still to FIG. 1, the head 22 is engaged onto a base 36. A vessel or bowl 38 within the base 36 holds electrolyte. One or more anodes are positioned in the vessel. The example shown in FIG. 1 has a center electrode 40 and a single outer electrode 42 surrounding and concentric with the center electrode 40. The anodes 40 and 42 may be provided in or below a di-electric material field shaping unit 44 to set up a desired electric field and current flow paths within the processor 20. Various numbers, types and configurations of electrodes may be used. A thief electrode 46 having a polarity opposite from the anodes may be located closer to the top of the vessel 38 to help to control the electric field around the wafer 100.

Figure 2:
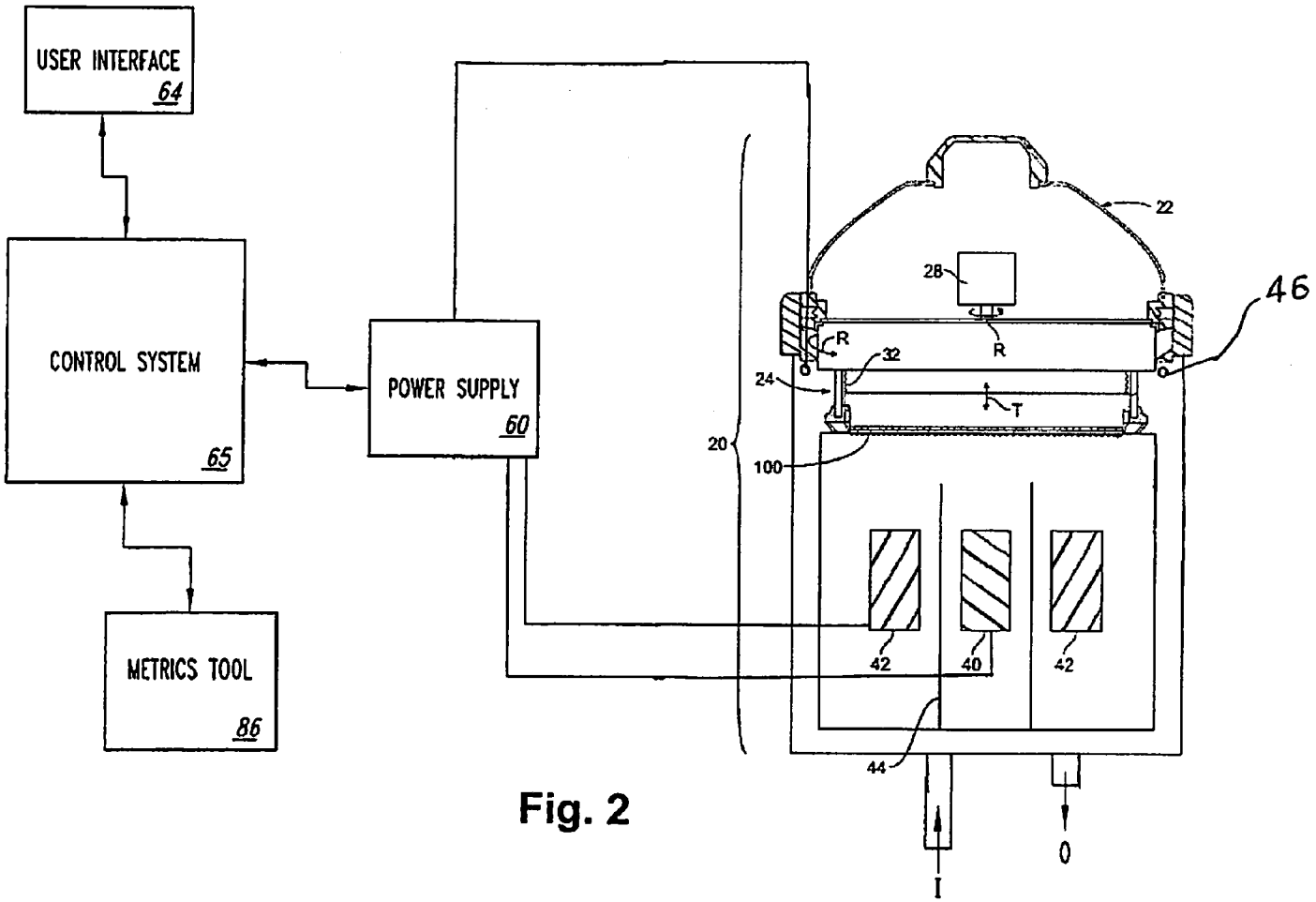
FIG. 2 is a schematic diagram showing the electroplating reactor of FIG. 1 in an electroplating system.

As shown in FIG. 2, a power supply 60 supplies electrical current to the anodes 40 and 42, and to the thief electrode 46. A control system 65 controls the power supply 60. The control system includes a computer which may be controlled and monitored via a user interface 64. Data on measurements made on previously plated substrates may be obtained using a metrics tool 86 which supplies the data to the control system 65. The control system 65 can then use the data to adjust the electrode current schedule to be used on a subsequent wafer or substrate.

The control system 65 controls an electroplating process having multiple steps, which is performed in the electroplating chamber 20 having two or more electrodes. For each electrode, (anodes and thief) the control system 65 determines the net plating charge delivered through the electrode during a first plating cycle to plate a first workplace. This is accomplished by summing the plating charges delivered through the electrode in each step of the process. The control system 65 then compares a plating profile achieved in plating the first workpiece to a target plating profile. In such comparison, the control system 65 identities deviations between the achieved plating profile and the target plating profile. The control system 65 determines new net plating charges for each electrode selected to reduce the identified deviations in the second workpiece. For each of these new net plating charges, the control system 65 distributes the new net plating charge across the steps of the process, and uses the distributed new net plating charges to determine a current for each electrode for each step of the process. A second plating cycle may then be conducted to plate a second workpiece using the currents determined for each electrode for each step.

Alternatively, the control system 65 electroplates a selected surface using a plurality of electrodes. The control system 65 obtains a current specification set comprised of a plurality of current levels, each specified for as particular one of the plurality of electrodes. The current levels of the current specification set each represent a modification of current levels of a distinguished current specification set, modified in order to improve results produced by electroplating in accordance with the distinguished current specification set. For each electrode, the control system 65 delivers the current level specified for the electrode by the current specification set to the electrode in order to electroplate the selected surface.

The optimizer, or optimizing, as used here refers to a technique for selecting and refining electrical parameters for processing a microelectronic workpiece in a processing chamber. The optimizer initially configures the electrical parameters, or electrical current supplied by an electrode, in accordance with either a mathematical model of the processing chamber or experimental data derived from operating the actual processing chamber. After a wafer is processed with the initial parameter configuration, the results are measured and as sensitivity matrix based upon the mathematical model of the processing chamber is used to select new parameters that correct for any deficiencies measured in the processing of the first workpiece. These parameters are then used in processing a second workpiece, which may be similarly measured, and the results used to further refine the parameters. In some embodiments, the optimizer analyzes a profile of the seed layer applied to a workpiece, and determines and communicates to a material deposition tool a set of control parameters designed to deposit material on the workpiece in a manner that compensates for deficiencies in the seed layer. An optimizer is described in U.S. Patent Application Publication No. 2002/0139878, incorporated herein by reference.

Dynamic current control (DCC) refers to a system and method of controlling the current of electrode in real time, to achieve a desired result. The distribution of electrical current from the electrodes to the workplace is actively changed during the plating process. For example, the current can be changed such that a current ratio of at least one electrical current to the sum of the electrical currents shifts from a first current ratio value to a second current ratio value. Accordingly, the current applied to the workpiece can be adjusted achieve a target shape for a conductive layer on the workpiece, or to account for temporally and/or spatially varying characteristics of the electrolytic process. DCC is described in US. Patent Application Publication No. 20030038035, incorporated herein by reference.

An algorithm for Dynamic Current Control (DCC) can be written as, $$\frac{i_k}{i_{wafer}} = F_k(v),\ v = [\kappa, Rs, H, p_{k1}, p_{k1}, \ldots],$$

where the subscript k denotes the $k^{th}$ electrode channel, i is current, F is a function, and v is a vector argument to this function. The vector v includes variables such as the bath conductivity (κ), the film sheet resistance (Rs), the wafer to cup distance (H), and other channel-specific parameters. The film sheet resistance, Rs, is determined from a function, G, i.e., $$Rs=G(d),$$

where d is the film thickness, which is a function of the local deposition rate and time (t).

Practical implementation of the continuous DCC curve requires subdividing the curve into discrete intervals over which a constant current is applied. To insure consistency of delivered charge, the fixed current during an interval is selected so as to match the charge delivered by the continuous curve over the same interval. The charge delivered by the $k^{th}$ electrode channel during a step time interval using a fixed channel current is determined by, $$(C_k)_l^{fixed} = i_{wafer}\int_{t_{l-1}}^{t_l} \frac{i_k}{i_{wafer}}\,dt = i_{wafer}\left(\frac{i_k}{i_{wafer}}\right)_l^{fixed}(t_l - t_{l-1}).$$

Similarly, the charge delivered during a variable-current, DCC step is computed from, $$(C_k)_l = i_{wafer}\int_{t_{l-1}}^{t_l} \frac{i_k}{i_{wafer}}\,dt = i_{wafer}\int_{t_{l-1}}^{t_l} F_k(v)\,dt.$$

Equating charges and solving for the fixed interval current gives, $$\left(\frac{i_k}{i_{wafer}}\right)_l^{fixed} = \frac{\int_{t_{l-1}}^{t_l} F_k(v)\,dt}{t_l - t_{l-1}}$$

The step time interval is selected so as to satisfy constraints on maximum allowable changes in both time and film sheet resistance.

Discrete time steps are selected by specifying either ΔRs or Δt on each step.

The process may specify the number of dynamic current control (DCC) steps, which determines ΔRs.

Figure 3:
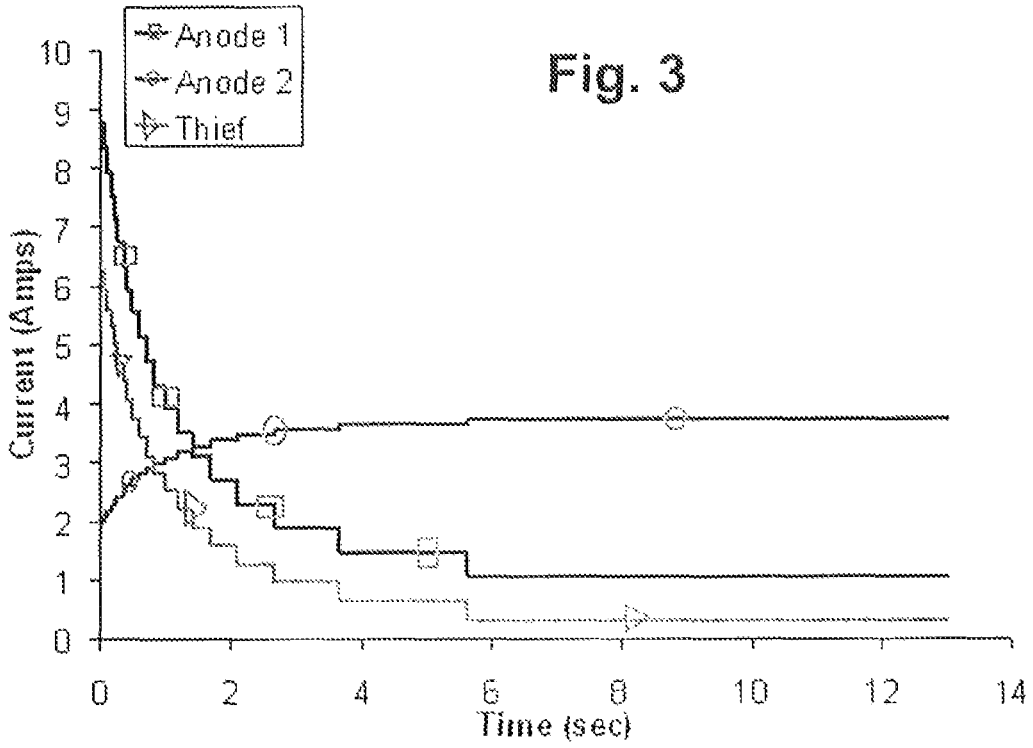
FIG. 3 is a graph of electrode currents using dynamic current control based on changes in sheet resistance on the substrate, with 20 steps or current changes, as described below.
Figure 4:
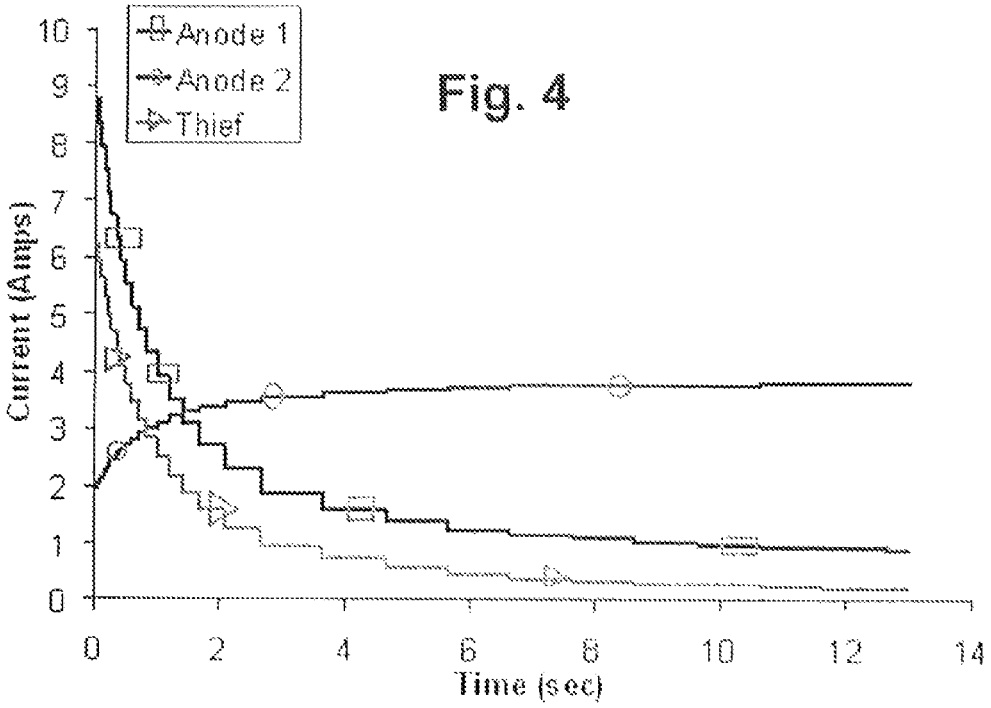
FIG. 4 is a graph of electrode currents using dynamic current control based on changes in sheet resistance on the substrate, with 100 steps or current changes.
Figure 5:
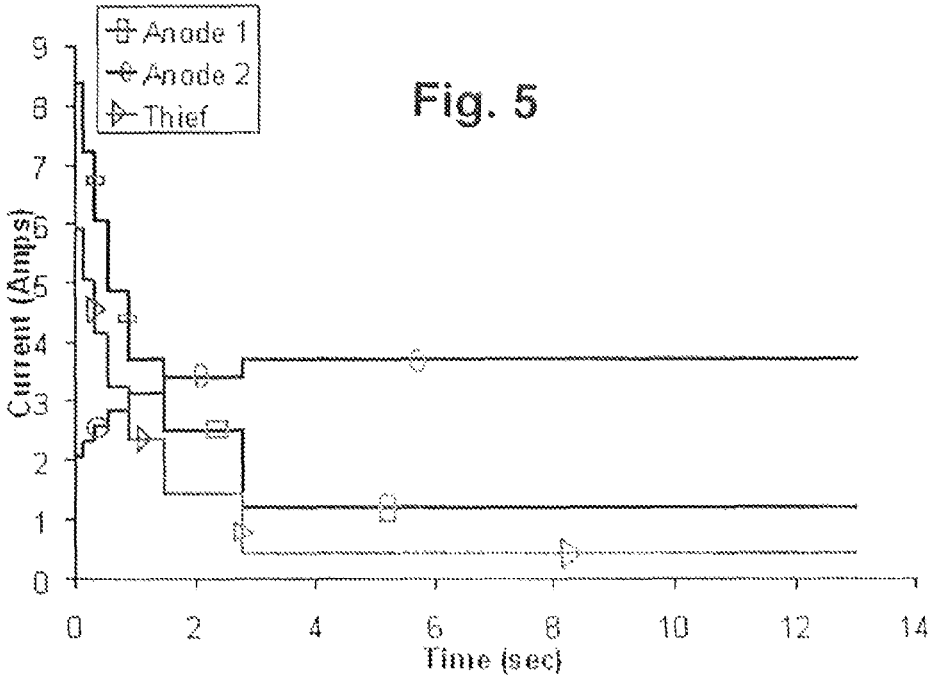
FIG. 5 is a graph of electrode currents using dynamic current control based on changes in sheet resistance on the substrate, with 7 steps or current changes.

FIG. 3 shows the electrode currents over time with this option, using 20 DCC steps. FIGS. 4 and 5 similarly show use of this option with 100 DCC steps, and with 7 DCC steps, respectively, $$\Delta Rs = \frac{(Rs)_{final} - (Rs)_{initial}}{\text{Number of steps}}$$

$$(Rs)_l = (Rs)_{initial} + l\cdot\Delta Rs$$

Alternatively, the process may specify the minimum allowed step change in both time and Rs. This allows early time steps to be the same as when the number of steps are specified, but avoids long duration steps towards the end of the process.

$$\Delta Rs_l = \text{Min}\{\Delta Rs_{input}, \Delta Rs_{\Delta t_{input}}\}$$

$$\Delta Rs_{\Delta t_{input}} = (Rs)_{\Delta t_{input}} - (Rs)_{l-1}$$

$$(Rs)_{\Delta t_{input}} = A\left(e^{\frac{B}{d_{l-1}+\gamma\Delta t_{input}}} - C\right)$$

Figure 6:
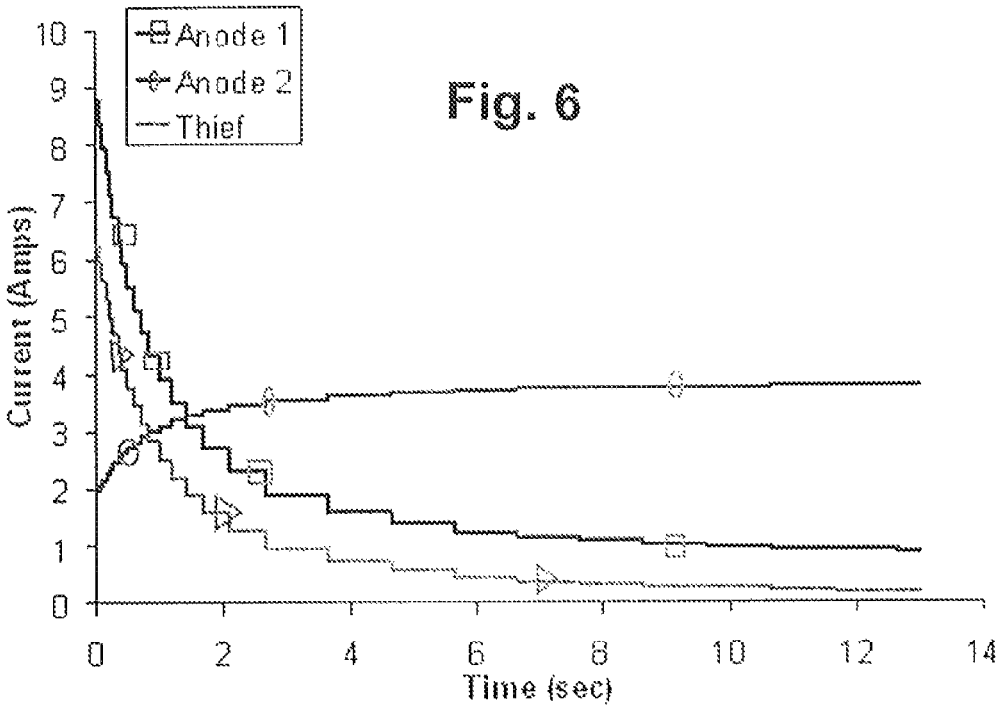
FIG. 6 is a graph of electrode currents using dynamic current control with a minimum allowed step change, and using 20 steps or current changes.
Figure 7:
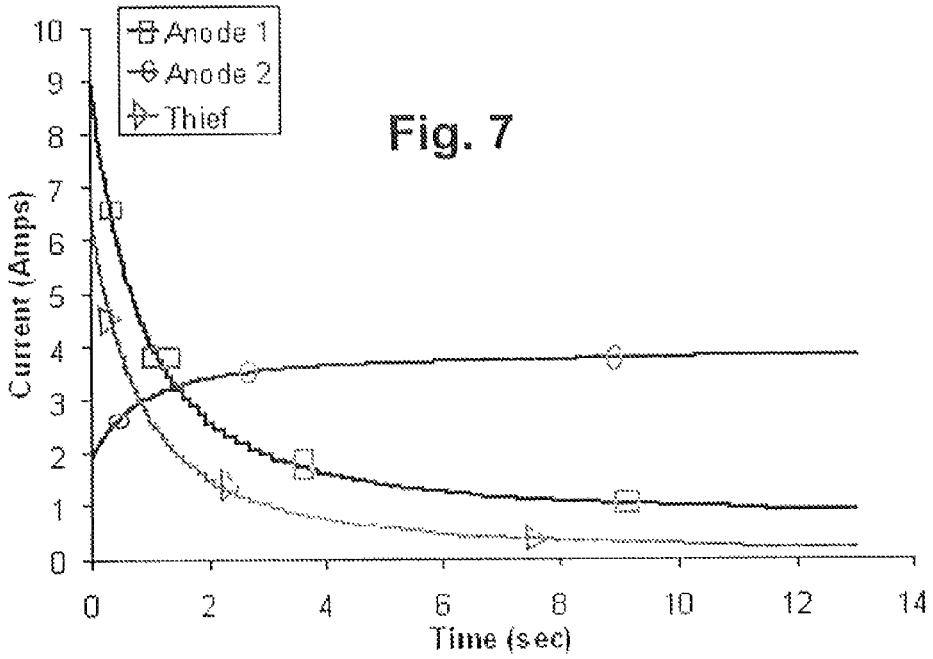
FIG. 7 is a graph of electrode currents using dynamic current control with a minimum allowed step change, and using 100 steps or current changes.
Figure 8:
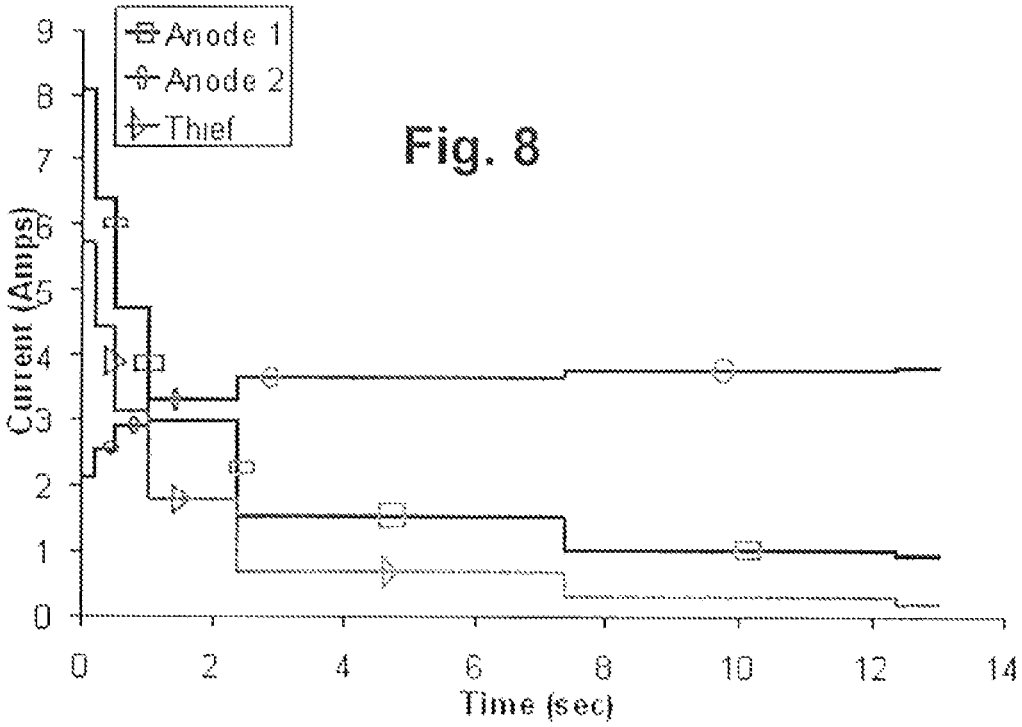
FIG. 8 is a graph of electrode currents using dynamic current control with a minimum allowed step change, and using 7 steps or current changes.

FIG. 6 shows the electrode currents over time with this second option, using 28 DCC steps. FIGS. 7 and 8 similarly show use of this option with 100 DCC steps, and with 7 DCC steps, respectively.

The change in the charge for a selected electrode may be related to the changes in either the DCC slope or the DCC intercept for that electrode. Relating the change in charge to the change in DCC intercept:

The optimizer computes a target change in electrode channel charge from an input set of thickness error values. For a fixed-current process, this results in a change in the fixed current values according to, $$(i_k)^{fixed} = \frac{1}{\Delta t}\{(C_k)^{fixed} + \Delta(C_k)^{fixed}\}$$

where $\Delta(C_k)^{fixed}$ represents the change in charge needed over the time interval, Δt. Note that the time interval, Δt, could correspond to a recipe step time, which is much longer than DCC segment times discussed above. For a variable current (DCC) step, the change in charge must be achieved by modifying the function, $F_k(v)$. For instance, if this modification is accomplished by changing the parameter, $p_k1$, and $F_k$ varies linearly $p_k1$, with then the change in this parameter can be computed from, $$\Delta p_{k1} = \frac{\Delta(C_k)}{\gamma},$$

where $$\gamma = \frac{\partial(C_k)}{\partial p_{k1}} = \frac{\partial}{\partial p_{k1}}\left[i_{wafer}\int_{t_1}^{t_2} F_k(v)\,dt\right]$$

where $\Delta(C_k)$ is the required change in charge during the time interval, Δt=t2−t1.

In the example below, the parameter is the intercept ($\Delta p_{k1}=\Delta b_k$), which reduces to the simple case of, $$\gamma = i_{wafer}\Delta t$$

$$\Delta b_k = \frac{\Delta(C_k)}{C_{wafer}}$$

The process may be implemented via the following steps:

1. Electroplate a first or test wafer having a thin seed layer in the electrochemical processor 20 using a first accelerated DCC schedule.

2. Measure the plated metal layer on the first wafer. The data measured in this step may output in a format analogous to the graph of FIG. 9 which shows the plated metal layer thickness starting at the center of the wafer (0 mm) out to the wafer edge at 150 mm, for a 300 mm diameter wafer.

3. Input data about the measurements (metal layer thickness values) of the first wafer into the optimizer section of the control system 65. This may be in an input sheet format.

4. Run the optimizer using the inputted data from step 3, to determine the changes to the Current schedule, specifically changes in amp-seconds for each electrode. The changes provide a new set of currents for each electrode, adapted for use with wafers having a thin seed layer comparable to the seed layer on the first wafer.

5. Electroplate a second wafer using the first DCC schedule, but with the starting current value of each electrode set per the new set of currents from step 4.

FIG. 3 shows an example with starting sheet resistance of 25 Ohm/sq; a deposition time of 13 seconds; 20 DCC steps; and 4.5 amps of wafer current.

FIG. 4 shows an example with starting sheet resistance of 25 Ohm/sq; a deposition time of 13 seconds; 100 DCC steps, and 4.5 amps of wafer current.

FIG. 5 snows an example with starting sheet resistance of 25 Ohm/sq; a deposition time of 13 seconds; a maximum step size of 5 seconds; a maximum Rs step size of 5 Ohms/sq; 7 DCC steps; and 4.5 amps of wafer current.

FIG. 6 shows an example with starting sheet resistance of 25 Ohm/sq; a deposition time of 13 seconds; a maximum step size of 1 second; a maximum Rs step it of 1.2 Ohms/sq; 28 DCC steps; and 4.5 amps of wafer current.

FIG. 7 shows an example with starting sheet resistance of 25 Ohm/sq; a deposition time of 13 seconds; a maximum step size of 0.2 seconds; a maximum Rs step size of 4.3 Ohms/sq; 28 DCC steps; and 4.5 amps of wafer current.

FIG. 8 shows an example with starting sheet resistance of 25 Ohm/sq; a deposition time of 13 seconds; 7 DCC steps; and 4.5 amps of wafer current. As apparent from these examples, one option is to specify the number of DCC steps, which then determines the change in Rs. Another option is specify a minimum allowed step change in time and/or Rs. The gap between the wafer, or the bottom surface of the wafer, and a field shaping element, such as the upper cup described in U.S. patent application Ser. No. 13/288,495, incorporated herein by reference.

Figure 9:
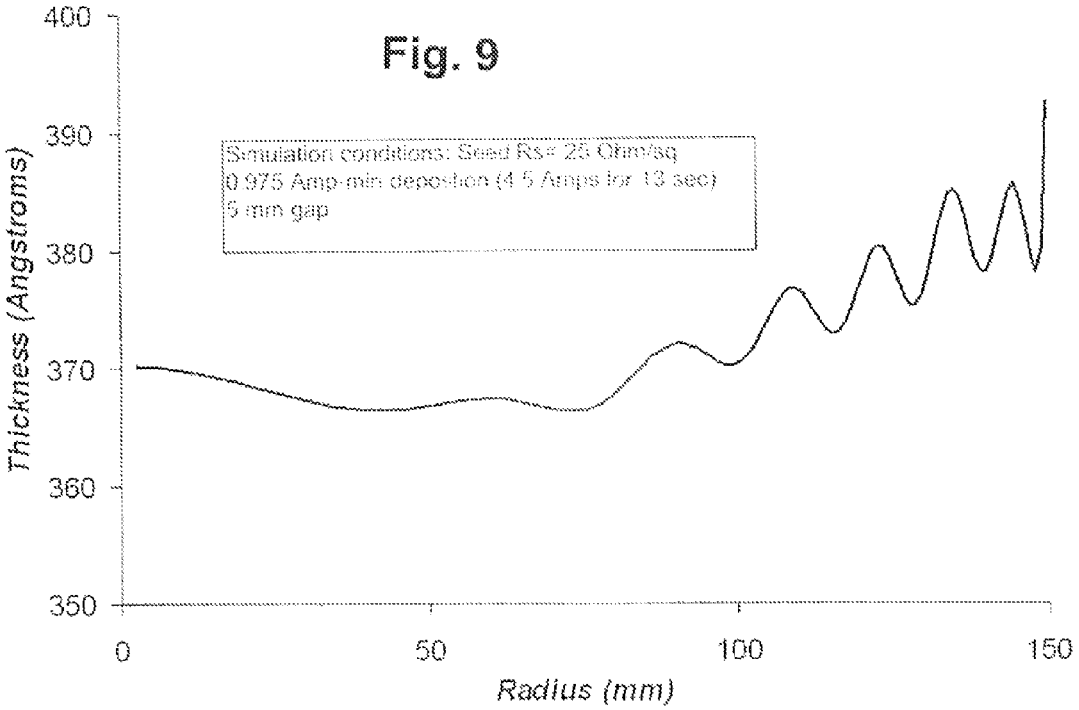
FIG. 9 is a graph of plated film thickness vs. radial position on the substrate.

FIG. 9 shows an example of plated metal layer thickness v. radial position on the wafer for a seed Rs=25 Ohms/sq; 0.975 Amp-min deposition (4.5 Amps for 13 seconds, and a 5 mm gap between the wafer and the field shaping element.

Thus, a novel apparatus and method has been shown and described. Various changes and substitutions may of course be made without departing from the spirit and scope of the invention. The invention, therefore, should not be limited except by the following claims, and their equivalents.

The invention claimed is:

1. A method for controlling an electroplating process in an electroplating chamber having, a plurality of electrodes, comprising:

applying electric current to each of the electrodes, with the current to each electrode varying over time according to a multi-variable function, with the current electroplating a layer of material onto a substrate, and with the multi-variable function varying linearly with the product of bath conductivity, sheet resistance, and a characteristic length;

integrating the multi-variable current function with respect to time, for each electrode, to determine a net plating charge delivered through each electrode;

comparing a plating profile of the layer of material to a target plating profile, and identifying deviations between the achieved plating profile and the target plating profile;

using the deviations to determine new net plating charges for each electrode, with the new net plating charges selected to reduce the identified deviations when processing a second subsequent workpiece;

changing one or more variables of the multi-variable function to provide a new multi-variable function;

for each new plating charge, distributing the new net plating charge over time according to the new multi-variable current function;

using the distributed new plating charges for each electrode to electroplate a layer of material on a second substrate.

2. The method of claim 1 further including changing electrode currents when the sheet resistance changes by 1 ohm/sq.

3. The method of claim 1 further including placing a wafer having an initial sheet resistance of greater than 50 Ω/sq into an electrolyte and passing electric current through the electrolyte, wherein during the first 15 seconds of processing, the electrode currents are changed between 50 and 1000 times.

4. The method of claim 1 wherein the multi-variable function is a linear function when current is plotted vs. sheet resistance.

5. The method of claim 1 wherein the multi-variable function depends upon a characteristic length of a vertical gap between the substrate and an electric field shaping element of the electroplating chamber.

6. The method of claim 1 wherein the slope of the multi-variable function is changed to achieve a new multi-variable function.

7. A method for controlling an electroplating process in an electroplating chamber having two or more anodes, comprising:

applying electric current to each of the anodes, with the current to each anode varying over time according to a multi-variable function, and with the current electroplating a layer of material onto a substrate;

integrating the multi-variable current function with respect to time, for each anode, to determine a net plating charge delivered through each anode;

comparing a plating profile of the layer of material to a target plating profile, and identifying deviations between the achieved plating profile and the target plating profile;

using the deviations to determine new net plating charges for each electrode, with the new net plating charges selected to reduce the identified deviations when processing a second subsequent workpiece;

changing one or more variables of the multi-variable function to provide a new multi-variable function;

for each new plating charge, distributing the new net plating charge over time according to the new multi-variable current function;

using the distributed new plating charges for each anode to electroplate a layer of material on a second substrate; and wherein the multi-variable function depends upon a characteristic length of a vertical gap between the substrate and an electric field shaping element of the electroplating chamber, and the multi-variable function varies linearly with the product of bath conductivity, sheet resistance, and the characteristic length.

* * * * *